US006311656B1

(12) United States Patent
Watanabe

(10) Patent No.: US 6,311,656 B1
(45) Date of Patent: Nov. 6, 2001

(54) VALVE TIMING CONTROL APPARATUS FOR INTERNAL COMBUSTION ENGINE

(75) Inventor: Masahiko Watanabe, Yokohama (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/639,073

(22) Filed: Aug. 16, 2000

(30) Foreign Application Priority Data

Aug. 17, 1999 (JP) ..... 11-230153

(51) Int. Cl.[7] ..... F01L 1/344
(52) U.S. Cl. ..... 123/90.17; 74/568 R; 464/2
(58) Field of Search ..... 123/90.15, 90.17, 123/90.31; 74/568 R; 464/1, 2, 160

(56) References Cited

U.S. PATENT DOCUMENTS

| | | | | |
|---|---|---|---|---|
| 5,836,276 | * | 11/1998 | Iwasaki et al. | 123/90.17 |
| 5,947,067 | | 9/1999 | Kawaharaguchi et al. | 123/90.17 |
| 6,129,063 | * | 10/2000 | Niethammer et al. | 123/90.17 |
| 6,173,686 | * | 1/2001 | Nakayoshi et al. | 123/90.17 |

FOREIGN PATENT DOCUMENTS 9-280018 10/1997 (JP) .
11-62522 3/1999 (JP) .

* cited by examiner

*Primary Examiner*—Weilun Lo
(74) *Attorney, Agent, or Firm*—Foley & Lardner

(57) ABSTRACT

A rotor member having vanes is rotatable in a housing in the forward and reverse directions by supplying and draining hydraulic pressure selectively to an advance side hydraulic chamber and a retard side hydraulic chamber, to change the relative rotational phase between a timing sprocket and a cam shaft and thereby to vary the opening and closing timings of an intake or exhaust valve. The rotor member has a bulge portion located at the side of one vane, and formed with an axially extending pin sliding hole for receiving a lock pin to prevent and allow relative rotation between the housing and rotor member by moving in and out of an engaging recess of the housing. A notch portion is formed in the outer circumferential surface of the bulging portion, to form an oil reservoir between the radially outwardly facing surface of the notch portion and the radially inwardly facing circumferential surface of the housing, for collecting abrasion metal powder generated by sliding friction of the lock pin, and thereby for protecting a seal member provided between each vane and the inner circumferential surface of the housing.

10 Claims, 5 Drawing Sheets

VALVE TIMING CONTROL APPARATUS FOR INTERNAL COMBUSTION ENGINE

BACKGROUND OF THE INVENTION

The present invention relates to a valve timing control apparatus for varying opening and closing timings of intake and exhaust valves of an internal combustion engine in accordance with engine operating conditions.

A published Japanese patent application Publication (Kokai) No. 09(1997)-280018 shows a conventional valve timing control apparatus of a vane type.

The outline is described with reference to FIGS. 4 and 5. This valve timing control apparatus includes a timing sprocket 50 having a tooth portion 50*a* on the outer periphery, a tubular housing 51 fixed to the main body of the timing sprocket 50 by bolts 63. A rotor member 54 is fixed to one end of a cam shaft 52 by a bolt 64, and received rotatably in the tubular housing 51. The housing 51 has four of projections having a generally trapezoidal section projecting radially inwardly. On the other hand, the rotor member 54 includes four of vanes or blades 54*a*, 54*b*, 54*c* and 54*d* each separating an advance side hydraulic chamber 55 and a retard side hydraulic chamber 56 between two adjacent projections. Each of the vanes 54*a*~54*d* has a seal member for sealing between the advance and retard hydraulic chambers 55 and 56, by sliding on the inner circumferential surface of the housing 51.

The rotating member 54 is rotated in the forward and reverse directions by supplying and draining hydraulic pressure to and from the advance and retard hydraulic chamber 55 and 56 in accordance with engine operating conditions, to change the relative rotation phase of the timing sprocket 50 and the cam shaft 52 and thereby to change the opening and closing timing of an intake valve.

Between the vane 54*a* and the timing sprocket 50, there is provided a locking mechanism 57 for preventing or allowing relative rotation between the timing sprocket 50 and the rotating member 54.

This locking member 57 includes a pin sliding hole 58 formed in the van 54*a* along the axial direction of the cam shaft 52, a lock pin 59 slidable in this pin sliding hole 58 in a manner immune from the influence of the centrifugal force generated by rotation, and a latching bore 60 formed in the inner end surface of the timing sprocket 50. Moreover, the lock pin 59 is urged toward the latching bore 60 by the spring force of a coil spring 61. The lock pin 59 can disengage from the latching bore 60 by the aid of hydraulic pressure of an oil pump supplied to a pressure receiving chamber at the rear end of the pin sliding hole 58.

When the pressure of the oil pump is still low as in a starting operation of the engine, the lock pin 59 urged into the latching bore 60 by the coil spring 61 can prevent collision and tapping noise between the housing 51 and the rotating member 54 due to forward and reverse torque fluctuation of the cam shaft.

When the hydraulic pressure from the oil pump rises with increase in the engine rotational speed, the lock pin 59 moves out of the latching bore 60 by the increased pressure in the pressure receiving chamber, and thereby allows the rotating member 54 to rotate freely.

SUMMARY OF THE INVENTION

By repeated sliding movement of the lock pin 59 along the pin sliding hole 58 into and out of the latching bore 60, sliding portions between the lock pin 59 and the pin sliding hole 58 and engaging portions between the edge of the latching bore 60 and the tip of the lock pin 59 become worn with time, producing abrasion metal powder. Since the abrasion metal powder has a higher specific gravity than the hydraulic fluid in the hydraulic chambers 55 and 56, it is liable to drift toward the inner circumferential surface of the housing 51 by the centrifugal force by rotation of the housing 51 and the rotating member 54. Consequently, this abrasion metal powder infiltrates between the outer surface of each seal member and the inner circumferential surface of housing 51, and thereby damages the outer surface of the seal member and the inner surface of the housing 51, so that the sealing performance between the housing 51 and the seal members and the durability of the seal members may decline.

It is therefore an object of the present invention to provide a valve timing control apparatus effective in performance and durability of sealing.

According to the present invention, a valve timing control apparatus for an internal combustion engine, comprises:

a rotating body receiving rotation from a crankshaft of the engine;

a cam shaft rotatable relative to the rotating body;

a housing stationary relative to one of the rotating body and the cam shaft, the housing including a hydraulic chamber, and an engaging recess;

a rotor member stationary relative to the other of the rotating body and the cam shaft, the rotor member including a vane extending radially and dividing the hydraulic chamber of the housing into an advance chamber and a retard chamber, and a pin sliding hole extending along an axial direction of the cam shaft;

a seal member provided at an outer end of the vane, for sealing between an inner circumferential surface of the housing and the outer end of the vane;

a hydraulic circuit selectively supplying and draining hydraulic fluid to and from the advance and retard chambers and thereby rotating the vane in one of a forward direction and a reverse direction;

a lock pin received slidably in the pin sliding hole of the rotor member, to prevent relative rotation between the housing and the rotor member by engaging with the engaging recess of the housing, and to allow relative rotation between the housing and the rotor member by disengaging from the engaging recess; and an oil reservoir being located radially between the pin sliding hole and the inner circumferential surface of the housing, and communicating with one of the advance chamber and retard chamber.

DETAILED DESCRIPTION OF THE INVENTION

Figure 1:
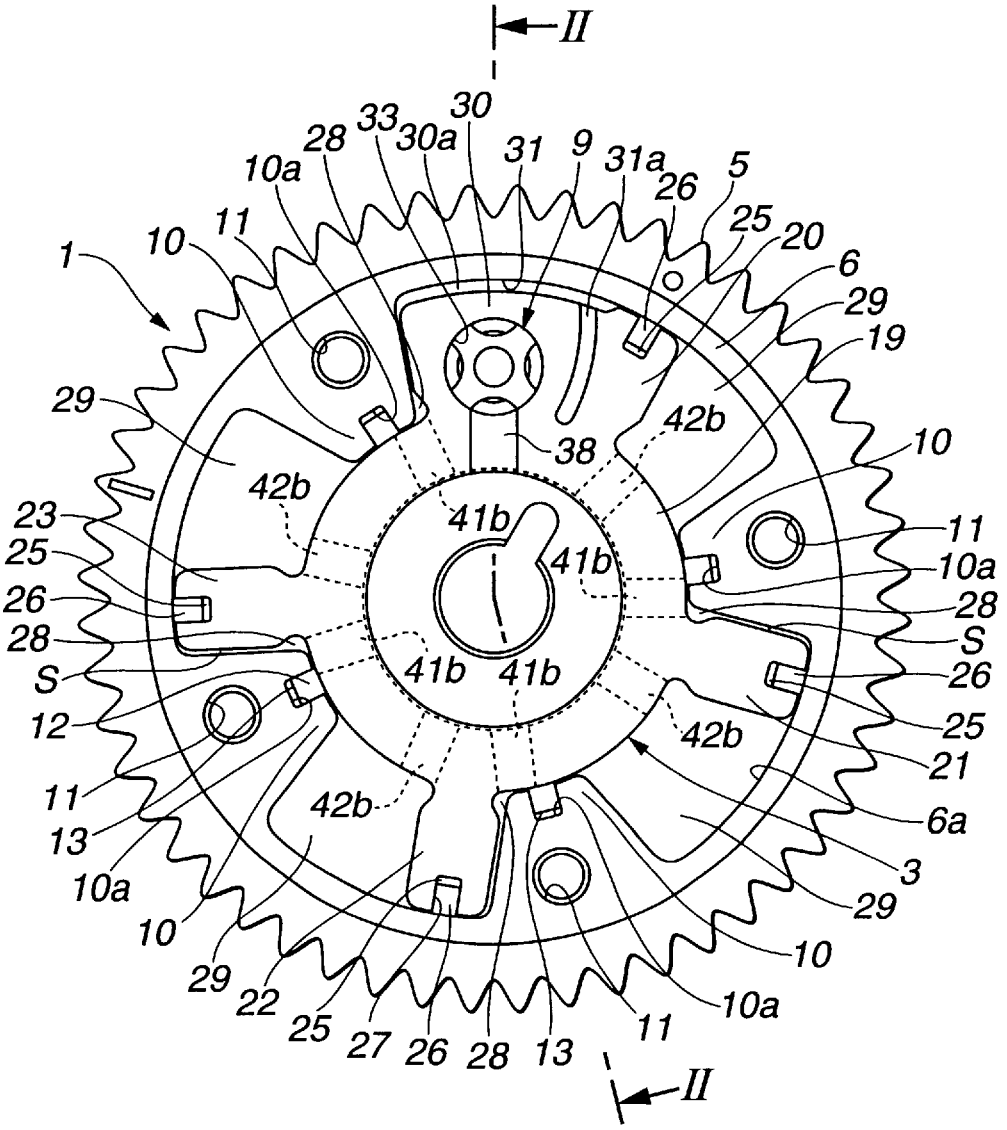
FIG. 1 is a cross-sectional view taken across a line I—I of FIG. 2, showing an embodiment of the present invention.
Figure 2:
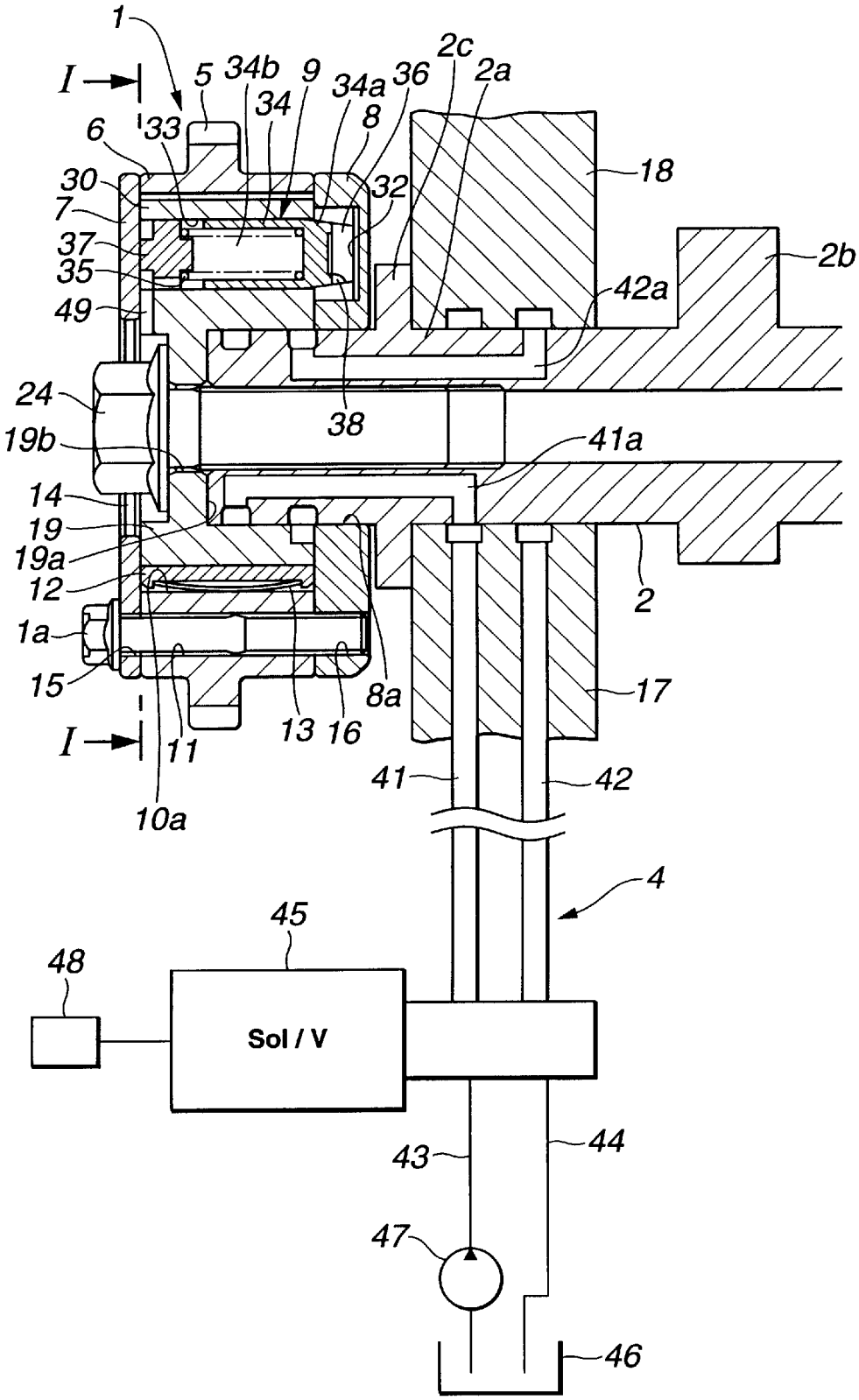
FIG. 2 is a sectional view taken across a line II—II of FIG. 1.

FIGS. 1 and 2 show an embodiment of a valve timing control apparatus for an internal combustion engine according to the present invention. In this embodiment, the valve timing control apparatus is for the intake valve's side.

A timing sprocket 1 shown in FIGS. 1 and 2 is a rotating body driven to rotate by a crankshaft of an engine (not shown) through a timing chain. A cam shaft 2 is rotatable relative to the timing sprocket 1. A rotor member or rotating member 3 is fixed to one end of the cam shaft 2, and rotatably supported in the timing sprocket 1. A hydraulic circuit 4 is for rotating the rotating member 3 in the forward and reverse directions by the hydraulic pressure. A locking mechanism 9 is for locking or unlocking the relative rotation of the timing sprocket 1 and the rotating member 3 at a predetermined position.

The timing sprocket 1, as shown in FIG. 2, has, on the outer periphery, a tooth portion 5 for engaging with the timing chain. In this embodiment, a housing is a member rotating as a unit with the timing sprocket 1. The housing of this embodiment includes a cylindrical housing member or portion 6 surrounding the rotating member 3, a disk-shaped front cover 7 for closing a front open end of the cylindrical housing member 6, and a generally disk-shaped rear cover 8 for closing a rear open end of the cylindrical housing member 6. In this embodiment, the cylindrical housing member 6 and the tooth portion 5 are integral parts of a single piece. The cylindrical housing member 6, the front cover 7 and the rear cover 8 are assembled into an integral unit by four of small-diameter bolts 1*a* extending along an axial direction of the timing sprocket 1 and cam shaft 2.

The cylindrical housing member 6 is shaped like a hollow cylinder opened at the front and rear ends, as shown in FIGS. 1 and 2. The housing member 6 has four of radial partitions 10 projecting radially inwardly at four positions arranged along the circumferential direction at intervals of about 90°. Each partition 10 has a trapezoidal cross section as shown in FIG. 1, and extends along the axial direction of the housing member 6. The front end of each partition 10 is flush with the front end of the housing member 6, and the rear end of each partition 10 is flush with the rear end of the housing member 6. Each partition 10 has an axially extending bolt through hole 11 near outer periphery of the housing member 6. The bolt hole 11 of each partition 10 is adapted to receive one of the small diameter bolts 1*a*. Furthermore, each partition 10 has a seal holding groove 10*a* extending along the axial direction at the middle of the inner end of the partition, and receiving therein a seal member 12 in the shape of a channel and a leaf spring 13 for pushing the seal member 12 inward.

A bolt through hole 14 having a relatively large diameter is provided at the center of the front cover 7. The front cover 7 further has four of bolt holes 15 at the positions corresponding to the bolt through holes 11 of the housing member 6, respectively.

The rear cover 8 has, at the center, a through hole 8*a*, as shown in FIG. 2, through which a front end portion 2*a* of the cam shaft 2 passes. The rear cover 8 further has four of bolt holes 16 formed at the positions corresponding to the bolt through holes 11 of the housing member 6, respectively. In the inside surface of the rear cover 8 near the outer periphery thereof, there is formed an later-mentioned engaging recess 32 opening axially toward the front cover 7, and serving as part of the locking mechanism 9.

The front end portion 2*a* of the cam shaft 2 is rotatably supported by the upper end of a cylinder head 17 through a cam bearing 18. The cam shaft 2 further has at least one driving cam 2*b* for actuating to open an intake valve through a valve lifter. The driving cam 2*b* is integrally formed on the outer peripheral surface at a predetermined position. An outward flange 2*c* is integrally formed on the outer periphery of the front end portion 2*a*.

The rotor member or rotating member 3, as shown in FIGS. 1 and 2, has a cylindrical rotor or boss 19 and four of vanes or blades 20, 21, 22 and 23 projecting radially outwardly from the rotor 19. In this example, the rotor 19 and the vanes 20~24 are integral parts of a single piece of sintered alloy. The rotor 19 has a center recess 19*a* for fittingly receive the front end portion 2*a* of the cam shaft 2, and a bolt through hole 19*b* receiving an axially extending fixing bolt 24 to fasten the rotor 19 to the front end portion 2*a* of the cam shaft 2.

Each of the first through fourth vanes or blades 20~23 is shaped like a plate having an approximately rectangular cross section, and disposed between two adjacent partitions 10 of the housing. Each vane has a seal holding groove 25 formed in the outer circumferential surface facing radially outwardly toward the inner circumferential surface of the housing member 6. The seal holding groove 25 extends axially at the middle of the outer circumferential surface of each vane. The seal holding groove 25 of each vane has, therein, a channel-shaped seal member 26 having an outer surface sliding on the inner circumferential surface 6*a* of the housing member 6, and a leaf spring 27 for pushing the seal member 26 outward.

Each of the four vanes 20~23 lies in a unique one of four spaces (or hydraulic chambers) each formed between two adjacent partitions 10 of the housing member 6, and divides the space (or hydraulic chamber) into an advance oil chamber 28 and a retard oil chamber 29. Each vane separates the advance chamber 28 formed circumferentially between the vane and the adjacent partition 10 on one side, and the retard chamber 29 formed circumferentially between the vane and the adjacent partition 10 on the opposite side.

A bulging portion (or bulge portion) 30 is formed between the first vane 20 and the adjacent partition 10 on the advance chamber'sside. The bulging portion 30 extends integrally from the outer surface of the rotor 19 in the radial outward direction. The bulging portion 30 is shaped like a fan, as shown in FIG. 1, and connected integrally with the confronting side of the first blade 20. The outer circumferential surface of the bulging portion 30 is formed with a notch portion 30*a* along the housing inner circumferential surface 6*a*. A concave oil reservoir 31 is formed between the outwardly facing surface of the notch portion 30*a* and the housing inner circumferential surface 6*a*. At each of the axial ends along the axial direction of the cam shaft 2, a groove 31*a* is formed circumferentially between the bulging portion 30 and the first blade 20. The groove 31*a* at each axial end extends radially and communicates with the advance chamber 28 through the oil reservoir 31. Moreover, approximately at the center of the bulging portion 30, there is formed a part of the locking mechanism 9.

The locking mechanism 9, as shown in FIGS. 1 and 2, includes the engaging recess 32 formed at the predetermined position in the inner surface of the rear cover 8, a pin sliding hole 33 formed approximately at the center position of the bulging portion 30, a lock pin 34 slidably received in the pin sliding hole 33, a coil spring 35 disposed on one side of the lock pin 34, and a pressure receiving chamber 36 formed between the lock pin 34 and the engaging recess 32. The engaging recess 32 has a conical inside surface. About the center of the bulging portion 30, the pin slide hole 33 extends along the axial direction of the camshaft 2 through the bulging portion 30, and opens toward the engaging recess 32 of the rear cover 8. The lock pin 34 is slidably received in the axially extending slide hole 33 in a manner not to suffer influence of the centrifugal force of rotation.

The lock pin 34 is in the form of a hollow cylindrical piece of metallic material, as shown in FIG. 2. The lock pin 34 has a closed rear end having a conical engaging portion 34*a* for engaging and disengaging in and from the engaging recess 32. The lock pin 34 has a cavity 34*b* having a bottom formed by the rear end of the lock pin 34, and an open end opening toward the front cover 7. A spring retainer 37 is fixed in the pin sliding hole 33 at the front end. The coil spring 35 is disposed between the bottom of the cavity 34*b* and the spring retainer 37, for urging the lock pin 34 axially toward the engaging recess 32. The oil pressure in the pressure receiving chamber 36 acts on the rear end of the lock pin 34 and pushes the lock pin 34 in the axial direction away from the engaging recess 32 (to the left in FIG. 2). The engaging recess 32 is positioned so that the engaging portion 34*a* of the lock pin 34 can move into the engaging recess 32 when the rotating member 3 is at the rotational position of the maximum retard angle.

The relative positions of the lock pin 34 and engaging recess 32 are so determined that each of the second, third and fourth vanes 21, 22 and 23 is slightly spaced with a narrow clearance S from the confronting side surface of the adjacent partition 10 on the advance chamber'sside in the state in which the engaging portion 34*a* of the lock pin 34 is engaged in the engaging recess 32 though the bulging portion 30 abuts against the confronting side surface of the adjacent partition 10. The dimension of the clearance S in the widthwise direction or the circumferential direction is determined by the average torque, the sliding friction and the size of the rotating member 3. This arrangement is effective for preventing adhesion between the vanes 21~23 and the partitions 10, and thereby improving the responsiveness of rotation. In addition to the clearances S separating the three vanes 21~23 from the partitions 10, it is optional further to provide a clearance to separate the bulging portion 30 from the side of the partition 10.

The pressure receiving chamber 36 is fluidly connected with the retard oil pressure chamber 29 through an oil hole 38 formed in the rear cover 8, and adapted to push the lock pin 34 in the leftward direction, as viewed in FIG. 2 to withdraw the engaging portion 34*a* from the engaging recess 32, against the spring force of the coil spring 35 by the hydraulic pressure applied from the retard oil pressure chamber 29 through the oil hole 38.

The spring force of the coil spring 35 is set by the relationship between positive/negative alternating torque fluctuation generated in the cam shaft 2 and the rotating member 3 during engine revolution and the hydraulic pressure supplied to the pressure receiving chamber 36. More specifically, the spring force of the coil spring 35 is set to a value to compress the coil spring only when a hydraulic pressure higher than the average value of the maximum peak value of the positive fluctuation torque and that of the negative fluctuation torque is applied to the pressure receiving chamber 36, that is when the hydraulic pressure corresponding to a torque within the range from the average value to the positive or negative maximum peak value is applied. A hole 49 shown in FIG. 2 is an air vent hole facilitating the sliding motion of the lock pin 34.

The hydraulic circuit 4, as shown in FIG. 2, has a first hydraulic passage 41 for supplying and draining the hydraulic pressure to and from the advance side hydraulic chambers 28, and a second hydraulic passage 42 for supplying and draining the hydraulic pressure to and from the retard side hydraulic chambers 29. These hydraulic passages 41 and 42 are selectively connected to an oil main gallery 43 and a drain passage 44 through an electromagnetic control valve 45. The oil main gallery 43 has an oil pump 47 for delivering oil under pressure from an oil pan 46. The downstream end of the drain passage 44 is communicated with the oil pan 46.

The first hydraulic passage 41 includes a first passage portion 41*a* formed generally in a channel shape from the inside of the cylinder head 17 to the inside of the front end portion 2*a* of the cam shaft 2, and four of branches 41*b* radially arranged in the rotor 19, for communication from the first passage portion 41*a* to each advance side hydraulic chamber 28.

On the other hand, the second hydraulic passage 42 includes a second passage portion 42*a* formed generally in a channel shape in the front end portion 2*a* of the cam shaft 2, and branch passages 42*b* arranged radially in the rotor 19 of the rotating member 3 for communication from the second passage portion 42*a* to each retard side hydraulic chamber 29.

The electromagnetic control valve 45 is a 4-port 2-position type valve having an internal valve element movable to select one of different connected states among the hydraulic passages 41 and 42, the oil main gallery 43 and the drain passage 44 under the control of a controller 48. The controller 48 detects the current operating conditions with a crank angle sensor for detecting an engine revolution and an air flow meter for detecting intake air quantity, and further detects the relative rotational position between the timing sprocket 1 and the cam shaft 2 by signals from the crank angle sensor and a cam angle sensor.

The valve timing control apparatus is operated as follows: First, in a starting operating or an idling operation of the engine, the electromagnetic control valve 45 receives the control signal from the controller 48 and connects the oil main gallery 43 with the second hydraulic passage 42 and the drain passage 44 with the first hydraulic passage 41. Therefore, the hydraulic pressure from the oil pump 47 is supplied to the retard side hydraulic chambers 29 through the second hydraulic passage 42. On the other hand, the advance side chambers 28 are supplied with no hydraulic pressure, and held in a low pressure state as in a stop state of the engine.

Accordingly, the rotating member 3 is put in the state shown in FIG. 1, wherein the side surface of the bulging portion 30 abuts against one side surface of the adjacent bulkhead 10 on the advance chamber'sside. Consequently the relative rotational position of the timing sprocket 1 and the cam shaft 2 is held to one side (the retard angle side) to control the intake valve opening and closing timings to the retard side. Thus, the timing control apparatus can improve the combustion efficiency by using inertial intake air, to the advantage of the stability of the engine revolution and the fuel economy.

Since, in this operating state, the hydraulic pressure in the retard chambers 29 still remains relatively low, the lock pin 34 is held engaged with the engaging recess 32 of the rear cover 8 by the spring force of the coil spring 35 overcoming the hydraulic pressure supplied from the oil hole 38 to the pressure receiving chamber 36. Thus, this timing control apparatus holds the rotating member 3 stably and reliably at the position of the retard angle side, thereby prevents swing vibration from being caused by variation of the hydraulic pressure in the retard side hydraulic chamber 29 or the positive/negative torque fluctuation of the cam shaft 2, and eventually prevents collision and resulting slapping noise between the bulging portion 30 and the vanes 21~23, and the partitions 10.

When the vehicle starts moving, and the engine operating points enters a predetermined low speed, low load region, the electromagnetic control valve 45 maintains the current operating condition, and the hydraulic pressure in the retard side hydraulic chamber 29 increases. According, the hydraulic pressure in the pressure receiving chamber 36 is increased to a level forcing the lock pin 34 to retract, against the spring force of the coil spring 35, out of the engaging recess 32, so that the rotating member 3 becomes free to rotate. However, the increased pressure in the retard side chambers 29 holds the rotating member stable.

When the engine enters the medium speed, medium load region, the controller 48 commands the electromagnetic control valve 45 to change the circuit connection to the state connecting the oil main gallery 43 with the first hydraulic passage 41 and connecting the drain passage 44 with the second hydraulic passage 42.

Therefore, the hydraulic circuit 4 drains the pressure from the retard side hydraulic chambers 29 to the oil pan 46 through the second hydraulic passage 42 and the drain passage 44, and thereby decreases the pressure in the retard chambers 29. On the other hand, the hydraulic circuit 4 supplies the pressure to the advance side hydraulic chambers 28 through the first passage 41, and thereby increases the pressure in the advance side hydraulic chambers 28. By this pressure, the rotating member 3 rotates clockwise from the position as shown in FIG. 1 through a maximum angular distance, to the position wherein the vanes 20~23 abut against the opposite side surfaces (the retard chamber'sside) of the partitions 10, respectively.

At the time of changeover from the advance angle side to the retard angle side, the hydraulic pressure in the retard side hydraulic chambers 29 is lowered by drainage, but the fluid in the retard side hydraulic chambers 29 is pressurized by rotation of the rotating member 3, so that the hydraulic pressure is held relatively high. As a result, the hydraulic pressure in the pressure receiving chamber 36 remains high enough to hold the lock pin 34 retracted against the coil spring 35. Thus the rotating member 3 rotates to the retard side hydraulic chamber'sside rapidly without restraint.

Accordingly, the timing sprocket 1 and the cam shaft 2 rotate relative to each other and vary the opening and closing timings of the intake valve to the advance side. This reduces the pumping loss of the engine, and increases the output.

When the high speed, high load region is reached, the electromagnetic control valve 45 changes the circuit interconnection to the state to connect the oil main gallery 43 with the second hydraulic passage 42 and the drain passage 44 with the first hydraulic passage 41, as in the idling operating. In this state, the pressure in the advance side hydraulic chambers 28 is lowered whereas the pressure in the retard side hydraulic chamber 29 is increased. Consequently, the rotating member 3 rotates counterclockwise to the state as shown in FIG. 1 to vary the opening and closing timings of the intake valve to the retard side. Thus, this timing control apparatus can improve the intake charging efficiency and increase the output.

When the engine is brought to a stop, the rotating member 3 is rotated, during an idling operation before stoppage, in the direction toward the advance side hydraulic chamber 28, to the state as shown in FIG. 1, and the engaging portion 34*a* of the lock pin 34 is pushed into the engaging recess 32 by the spring force of the coil spring 35. If the engine stops abruptly without passing through an idling operation, the rotating member 3 rotates toward the advance side hydraulic chamber 28 by the fluctuation torque generated in the cam shaft 2, and the lock pin 34 is engaged into the engaging recess 32.

This valve timing control apparatus can hold the rotating member 3 at a desired intermediate position by supplying or draining hydraulic pressure appropriately to or from the advance and retard chambers in accordance with the operating conditions of the engine.

The lock pin 34 slides back and forth repeatedly in the slide hole 33 into and out of the engaging recess 32, and thereby tends to produce abrasion metal powder by sliding friction in the pin sliding hole 33 and the engaging recess 32. The metal powder flows with hydraulic fluid in the radial outward direction toward the housing inner circumferential surface 6*a* by the centrifugal force generated by rotation of the timing sprocket 1, and gathers in the oil reservoir 31. Thus, the oil reservoir 31 functions to prevent the metal power from flowing into the interspace between the outer circumferential surface of the first blade 20 and the housing inner circumferential surface 6*a*. The grooves 31*a* functions to intercept the metal powder flowing from the oil reservoir portion 31 toward the first vane 20, and protects the seal member 26 and the housing inner circumferential surface 6*a*. The oil reservoir 31 is located at the position closest to the source of abrasion metal powder, so the oil reservoir portion 31 can efficiently collect power and prevent flow toward the seal member 26.

The metal power collected in the reservoir 31 and the grooves 31*a* is readily returned with the fluid to the oil pan 46 through the first hydraulic passage 41 when the fluid is drained from the advance side chambers 28 as in the case of transition to the high speed region range.

Accordingly, this timing control apparatus can protect the outer surfaces of the seal members 26 and housing inner peripheral surface 6*a* from being scratched by metal power, and thereby improve the sealing effect of the seal members 26 as well as the durability of the seal members 26 and the housing 6.

In this embodiment, the oil reservoir 31 is formed in the bulging portion 30 formed at the side of one of the vanes. This design increases the circumferential distance and the angular distance between the oil reservoir 31 and the nearest seal member 26, and the concave shape of the oil reservoir 31 improves the powder collecting efficiency.

Moreover, the pin sliding hole 33 is formed in the bulging portion 30 at the side of the vane 20. This arrangement eliminates adverse influence on the sealing effect between each of the front and rear end surface of the vane and the front or rear cover 7 or 8.

The rotating member 3 of this embodiment is a single piece of sintered alloy which can be manufactured at a lower cost, despite its relatively complicated structure inclusive of the bulging portion 30.

The grooves 31*a* communicating with the advance side hydraulic chamber 28 through the oil reservoir portion 31 is advantageous for eliminating a pressure difference between the grooves 31*a* and the advance side hydraulic chamber 28, and thereby preventing the fluid from flowing between the front or rear end of the bulging portion 30 and the inner surface of the front or rear cover 7 or 8. This stabilizes the movement of the lock pin 34.

In this embodiment, the timing control apparatus varies the valve opening and closing timings by supply and drainage of the hydraulic pressure, and utilizes the spring force of the coil spring 35 of the locking mechanism 9 set to the special value as mentioned above. Therefore, this apparatus restrains vibration of the rotating member 3 due to fluctuation torque in the initial period of unlocking, prevents slapping noise of the rotating member against the partitions 10, and thereby improves the durability of the rotating member 3.

Figure 3:
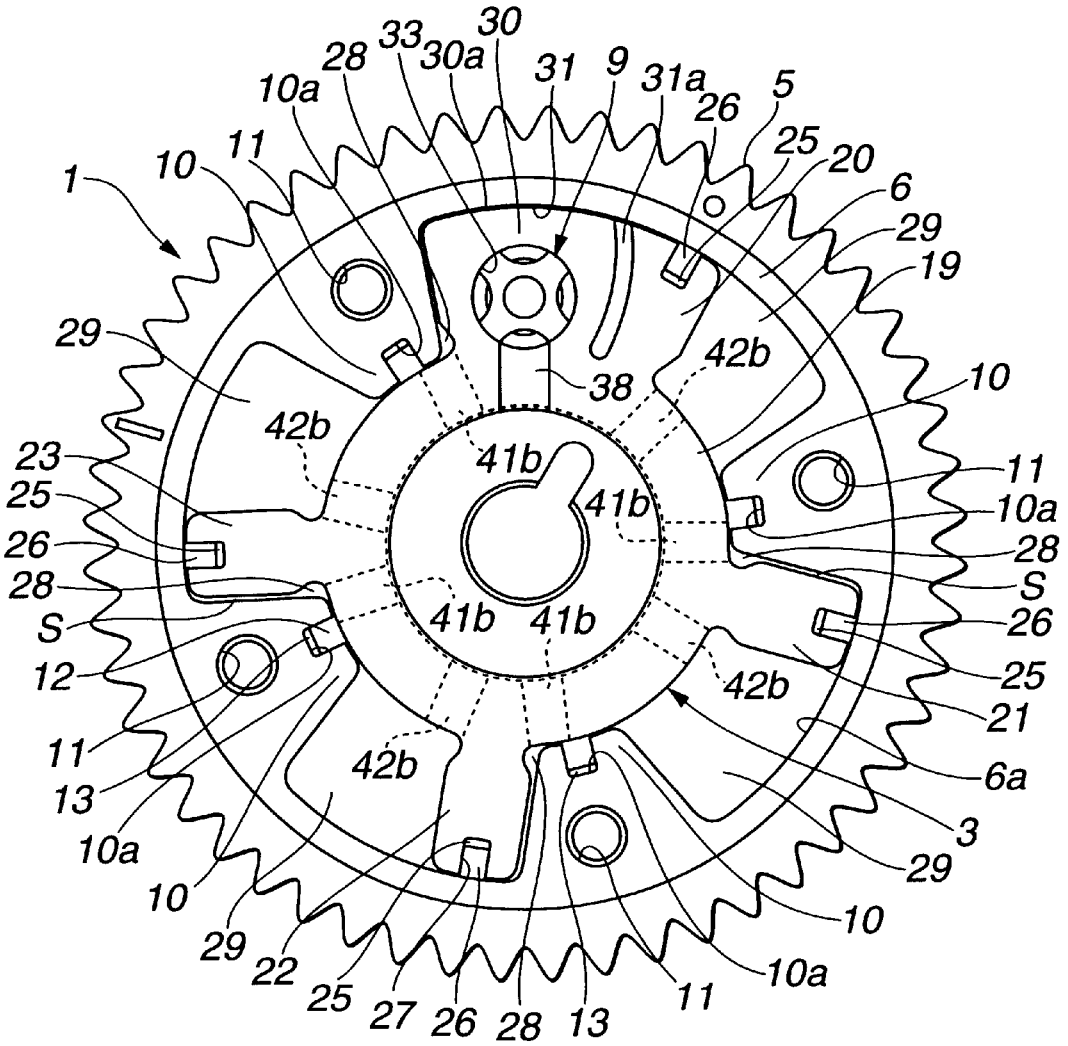
FIG. 3 is a cross-sectional view taken across a line I—I of FIG. 2, showing another embodiment of the present invention.
Figure 4:
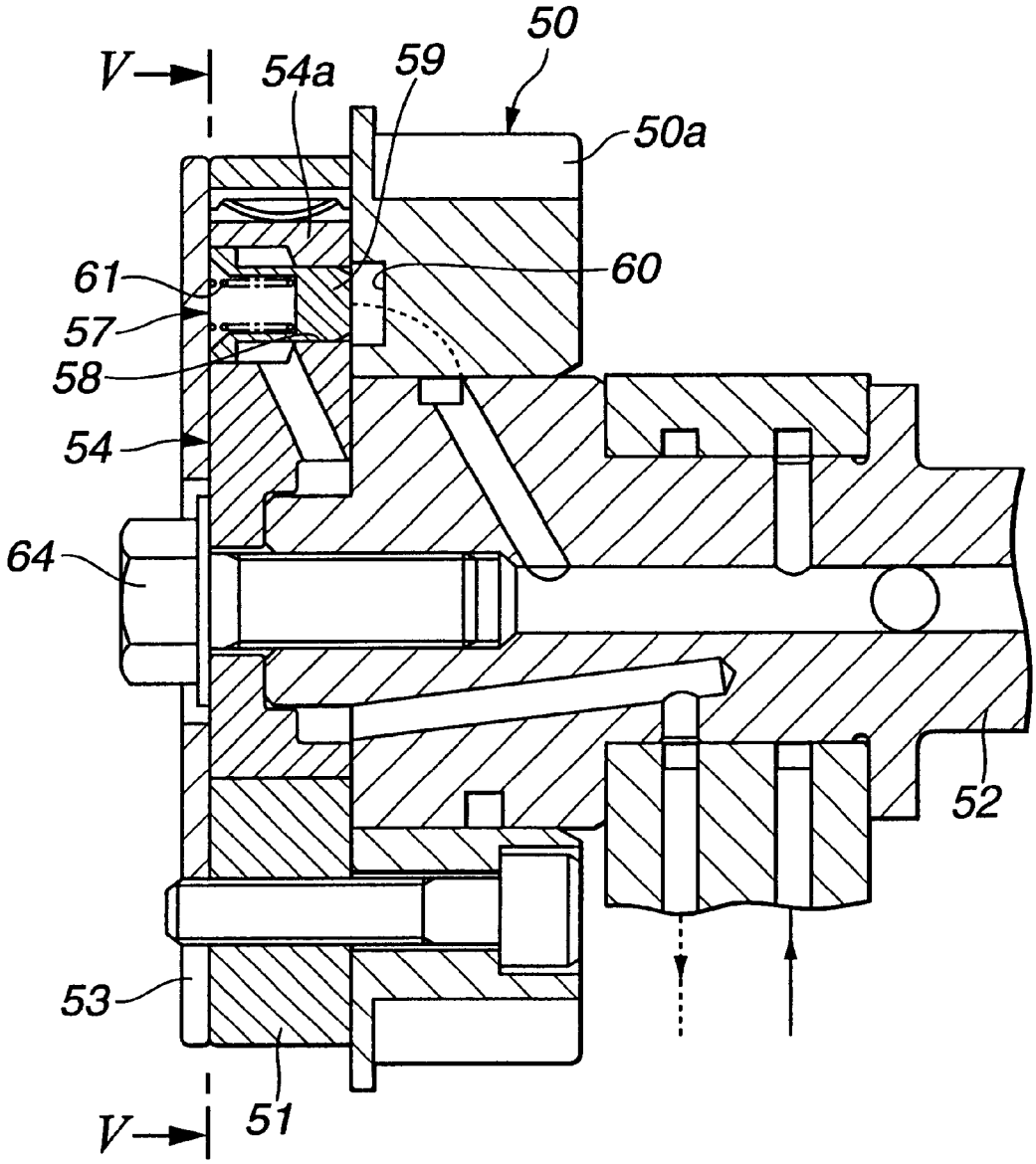
PRIOR ART FIG.4
FIG. 4 is a sectional view showing a conventional valve timing control apparatus.
Figure 5:
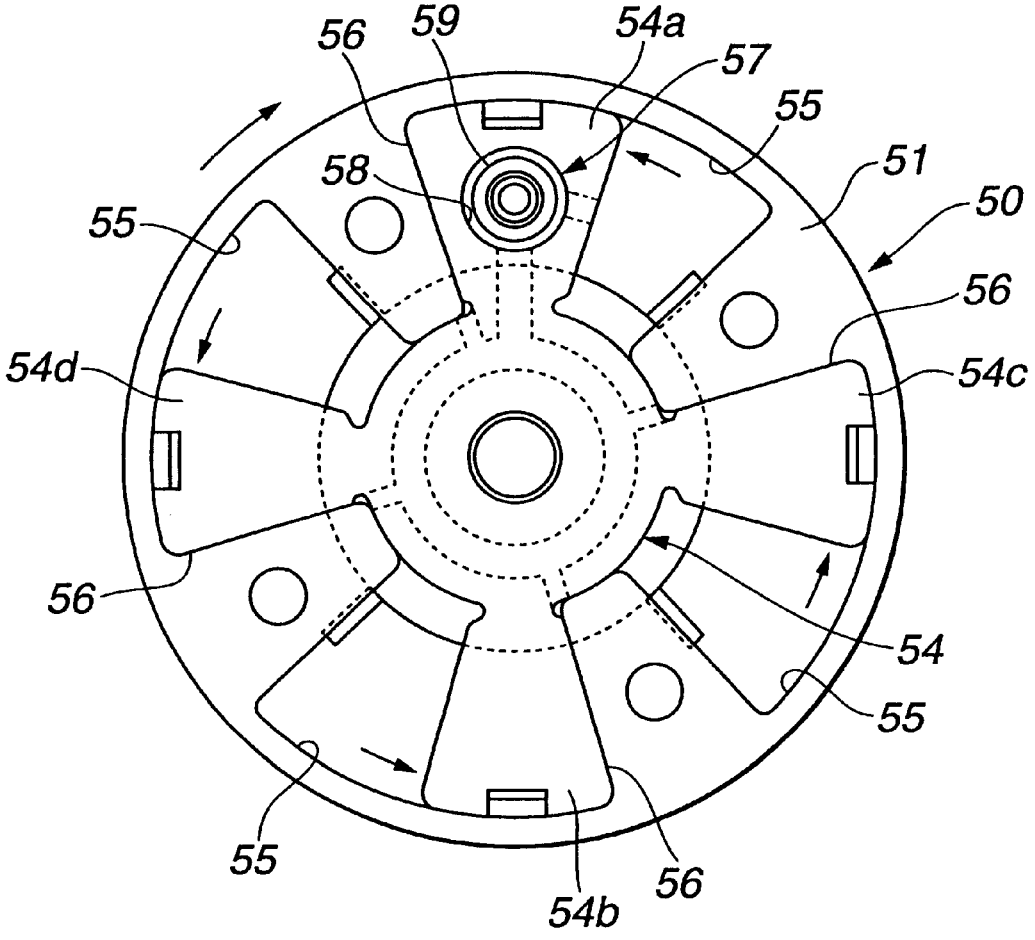
PRIOR ART FIG.5
FIG. 5 is a cross-sectional view taken across a line V—V of FIG. 4.

FIG. 3 shows another embodiment of the present invention. The rotating member 3 has the bulging portion 30 at the side of the first vane 20 as in the preceding embodiment. The oil reservoir 31 is formed not by notching the outer circumferential surface of the bulging portion 30, but by forming a narrow clearance between the inner circumferential surface of the housing 6 and the outer circumferential surface of the bulging portion 30 facing toward the inner circumferential surface of the housing 6. In this embodiment, the outer circumferential surface of the bulging portion 30 and the outer circumferential surface of the vane 20 form a common (cylindrical) surface . This oil reservoir 31 prevents the flow of abrasion metal powder toward the seal member 26. The second embodiment requires no notch in the outer circumferential surface of the bulging portion 30, and thereby facilitates the forming process of the rotating member 3 to the advantage of the production efficiency.

The present invention is not limited to the illustrated embodiments. For instance, instead of supplying the hydraulic pressure to the pressure receiving chamber 36 of the locking mechanism 9 from the retard side hydraulic chambers 29, it is possible to provide a hydraulic circuit independent from the hydraulic circuits for the advance and retard chambers 28 and 29.

In order to ensure the rotation balance between the vane 20 near the bulging portion 30 and the other vanes 21~23, it is also possible to increase the wall thickness of the third vane 22 opposite to the first vane 20.

Furthermore, it is possible to form a V-shaped clearance separating the first vane 20 and the bulging portion 30 instead of forming the vane 20 and the bulging portion as an integral portion.

This application is based on a Japanese Patent Application No. 11(1999)-230153. The entire contents of this Japanese patent application No. 11(1999)-230153 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, the valve timing control apparatus comprising:

a rotating body receiving rotation from a crankshaft of the engine;

a cam shaft rotatable relative to the rotating body;

a housing stationary relative to one of the rotating body and the cam shaft, the housing comprising a hydraulic chamber, and an engaging recess;

a rotor member stationary relative to the other of the rotating body and the cam shaft, the rotor member comprising a vane extending radially and dividing the hydraulic chamber of the housing into an advance chamber and a retard chamber, and a pin sliding hole extending along an axial direction of the cam shaft;

a seal member provided at an outer end of the vane, for sealing between an inner circumferential surface of the housing and the outer end of the vane;

a hydraulic circuit selectively supplying and draining hydraulic fluid to and from the advance and retard chambers and thereby rotating the vane in one of a forward direction and a reverse direction;

a lock pin received slidably in the pin sliding hole of the rotor member, to prevent relative rotation between the housing and the rotor member by engaging with the engaging recess of the housing, and to allow relative rotation between the housing and the rotor member by disengaging from the engaging recess; and an oil reservoir being located radially between the pin sliding hole and the inner circumferential surface of the housing, and communicating with one of the advance chamber and retard chamber.

2. A valve timing control apparatus as set forth in claim 1, wherein the housing comprises a pressure receiving chamber communicating with one of the advance chamber and retard chamber and receiving a fluid pressure for pushing the lock pin in a disengaging direction to disengage the lock pin from the engaging recess, and the valve timing control apparatus further comprises a spring pushing the lock pin in an engaging direction to engage the lock pin with the engaging recess; wherein the housing comprises a plurality of radially arranged partitions defining a plurality of the hydraulic chambers, and the rotor member comprises a plurality of the vanes each of which divides a unique one of the hydraulic chambers into the advance chamber and retard chamber, and each of which is provided with the seal member; and wherein the pin sliding hole and the oil reservoir are located at a position circumferentially between the seal member of one of the vanes and one of the partitions.

3. A valve timing control apparatus as set forth in claim 1, wherein the housing comprises an inside circumferential surface facing radially inwardly, the vane comprises an outer circumferential surface facing radially outwardly toward the inside circumferential surface of the housing, and a seal groove depressed from the outer circumferential surface of the vane, the oil reservoir is defined by a depressed surface facing radially outwardly toward the inside circumferential surface of the housing, and a radial distance of the depressed surface from the axis of the cam shaft is shorter than a radial distance of the outer circumferential surface of the vane.

4. A valve timing control apparatus as set forth in claim 1, wherein the rotor member further comprises a bulge portion in which the pin sliding hole and the oil reservoir are formed, and the vane and bulge portion project in two different radial outward directions.

5. A valve timing control apparatus as set forth in claim 4, wherein the rotor member comprises an oil groove extending radially at a position circumferentially between the vane and the bulge portion and communicating with one of the advance chamber and retard chamber through the oil reservoir.

6. A valve timing control apparatus as set forth in claim 1, wherein the rotor member is a single piece of sintered alloy.

7. A valve timing control apparatus as set forth in claim 1, wherein the rotating body is in the form of a timing sprocket, the housing is combined with the rotating body so that the rotating body and the housing rotate as a unit, the rotor member is combined with the cam shaft so that the rotor member and the cam shaft rotate as a unit.

8. A valve timing control apparatus for camshaft drive of an internal combustion engine, the valve timing control apparatus comprising:

a housing comprising first and second radial partitions defining a first hydraulic chamber therebetween, and at least one further radial partition defining a second hydraulic chamber, and an engaging recess; and a rotor member rotatable in the housing, the rotor member comprising, a boss, a first vane extending into the first hydraulic chamber radially from the boss and dividing the first hydraulic chamber of the housing into an advance fluid pressure chamber for receiving a fluid pressure to force the rotor member in a first rotational direction and a retard fluid pressure chamber for receiving a fluid pressure to force the rotor member in a second rotational direction, a second vane extending in the second hydraulic chamber radially from the boss and dividing the second hydraulic chamber of the housing into an advance fluid pressure chamber for receiving a fluid pressure to force the rotor member in the first rotational direction and a retard fluid pressure chamber for receiving a fluid pressure to force the rotor member in the second rotational direction, and a bulge portion formed with a pin sliding hole extending along an axial direction of the rotor member, and receiving a lock pin movable axially into and out of the engaging recess of the housing to lock and unlock relative rotation between the housing and the rotor member, the bulge portion projecting radially from the boss into the first hydraulic chamber and lying circumferentially between the first vane and the first radial partition of the housing, the bulge portion being further formed with a depressed portion which opens toward an inside circumferential surface of the housing and which is depressed toward an axis of the rotor member.

9. A valve timing control apparatus as set forth in claim 8, wherein the depressed portion is depressed away from the inside circumferential surface of the housing, to increase a radial clearance between the bulge portion and the inside circumferential surface of the housing, so that the radial clearance in the depressed portion between the bulge portion and the inside circumferential surface of the housing is greater than a radial clearance between the first vane and the inside circumferential surface of the housing.

10. A valve timing control apparatus as set forth in claim 8 wherein the depressed portion comprises a groove extending radially at a circumferential position circumferentially between the bulge portion and the first vane.

* * * * *